US005083953A

United States Patent [19]

Richardson

[11] Patent Number: 5,083,953

[45] Date of Patent: Jan. 28, 1992

[54] TRANSFERRABLE AND REUSABLE MARKER AND RETRIEVAL SYSTEM FOR WATER TRANSPORT OBJECTS SUBJECT TO POSSIBLE SINKING

[76] Inventor: Charles D. Richardson, c/o Richardson & Doyle, Box 1549, Sechelt, B.C., Canada, V0N 3A0

[21] Appl. No.: 552,065

[22] Filed: Jul. 13, 1990

[51] Int. Cl.[5] ..... B63B 22/16

[52] U.S. Cl. ..... 441/6; 114/51; 441/25

[58] Field of Search ..... 114/50, 51, 44; 43/17.2; 294/82.32, 91; 441/6, 7, 23-25, 21

[56] References Cited

U.S. PATENT DOCUMENTS

| | | | |
|---|---|---|---|
| 3,016,649 | 1/1962 | Ratcliff | 43/17.2 |
| 4,000,533 | 1/1977 | Higgs | 441/7 |

FOREIGN PATENT DOCUMENTS

| | | | |
|---|---|---|---|
| 721640 | 1/1933 | France | 114/51 |
| 538561 | 8/1941 | United Kingdom | 114/51 |

*Primary Examiner*—Ed Swinehart
*Attorney, Agent, or Firm*—Stanley E. Johnson

[57] ABSTRACT

An improved apparatus for use in association with a vessel to facilitate raising the vessel and/or cargo carried thereby should it become sunken. The apparatus is readily attachable to or mountable on any equipment and includes a float having an upper portion with the upper portion being of larger cross-sectional area. The bottom portion has a recess therein. A cable drum is located in the recess and journaled for rotation to pay out a light duty line wound thereon. The light duty line has a knob attached thereto and which is also attached to a heavy duty lifting cable attached to secure lift points on the vessel. The float is mounted at an appropriate location on the vessel, or cargo and should the vessel or cargo (as the case may be) sink, it floats to the surface. Information concerning the sunken object size, equipment for retrieval, etc. is on a plate attached to the float. A rescue vessel uses a pull line with a sleeve thereon that slides down the light duty line to the lifting knob and after passing the same, dogs on the sleeve engage the knob. For heavier duty applications a second heavier duty pull line, with a sleeve thereon slides over the first line and knob engaging a second knob on a heavy duty cable attached to the sunken object. The rescue vessel is then able to pull directly on the heavy duty line to raise the sunken object.

2 Claims, 2 Drawing Sheets

FIG. 4
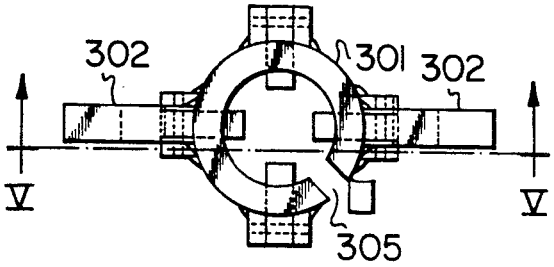
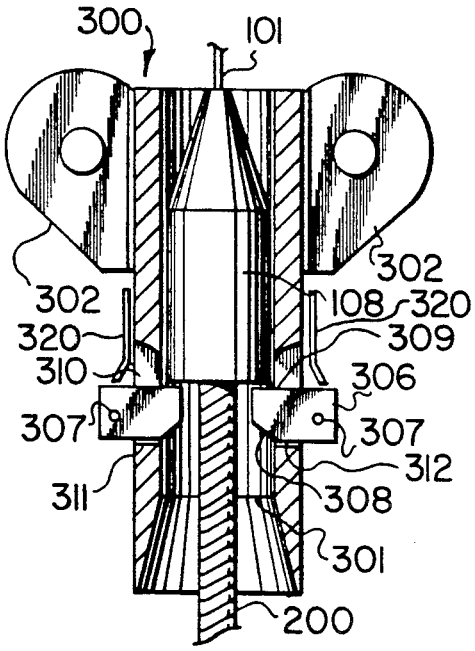
FIG. 5
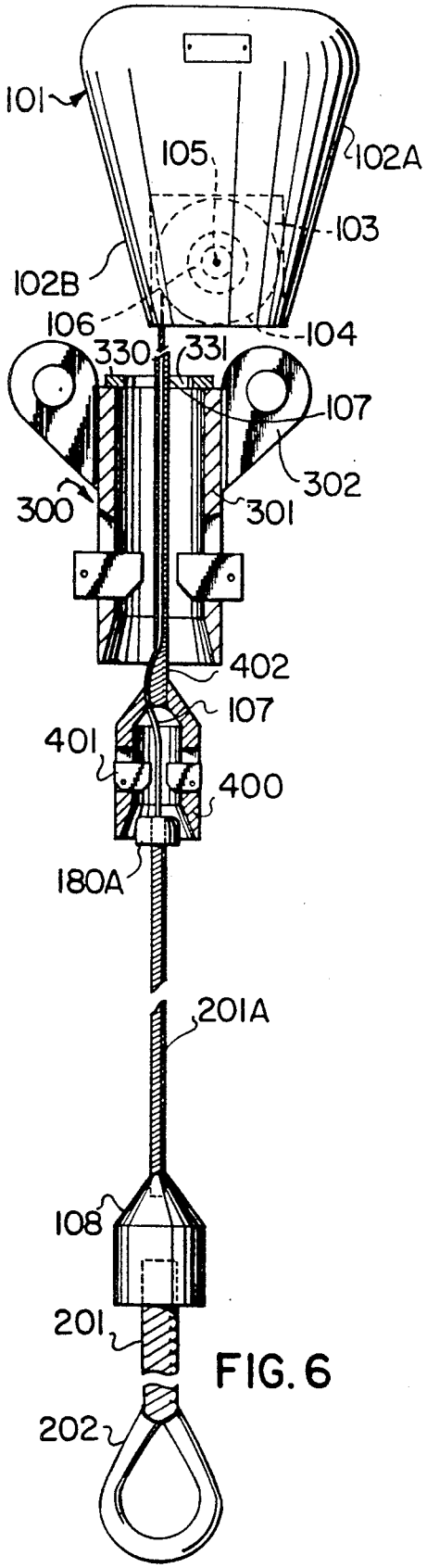
FIG. 6

TRANSFERRABLE AND REUSABLE MARKER AND RETRIEVAL SYSTEM FOR WATER TRANSPORT OBJECTS SUBJECT TO POSSIBLE SINKING

FIELD OF INVENTION

This invention relates generally to water transportation and more particularly to a marker and retrieval system transferrable from one object to another such as articles carried by vessels and/or the vessels themselves that could possibly sink during use. The present invention is applicable to vessels of any size from small, medium and large size pleasure craft to larger utility or commercial type vessels and/or objects carried thereby.

Logging boats, for example, are a special vessel designed for maneuverability. They are boats costing in the range of $100,000.00 each and because of their design and/or use are highly susceptible to sinking. A sunken vessel should be retrieved as soon as possible and if done say within a 48 hour period, the diesel motors and other mechanical equipment can be readily flushed, dewatered and is reusable without damage. A marker and retrieval system of the present invention renders possible a quick retrieval.

Water transport by barge of goods and equipment such as logging trucks, crawler tractors, industrial mining or fish process equipment and chemical containers is common in mountainous regions, for example, inland and on the west coast of British Columbia.

The apparatus of the present invention is of a portable nature and can be attached to such goods during transport and detached therefrom for use with the next load. Should a mishap occur during transport, any goods, e.g. a crawler tractor, can be readily located and quickly retrieved.

BACKGROUND OF INVENTION

Vessel marker and retrieval systems are known and by way of example, reference may be had to the following U.S. Pat. Nos. 526,959 issued Oct. 2, 1894 to E. M. Arnold; 1,331,014 issued Feb. 17, 1920 to P. Kawinski; 1,198,738 issued Sept. 19, 1916 to O. Maneval; 1,404,921 issued Jan. 31, 1922 to J. M. Adams; 1,177,889 issued Apr. 4, 1916 to C. F. Ostergren; 2,347,690 issued May 2, 1944 to W. K. Kannenberg; 2,641,780 issued June 16, 1953 to C. B. Brown et al; 1,142,768 issued June 8, 1915 to J. Barraja-Frauenfelder; 2,373,502 issued Apr. 10, 1945 to J. F. Prows; 1,412,202 issued Apr. 11, 1922 to J. M. Adams; 1,256,365 issued Feb. 12, 1918 to E. H. Pettit; 3,853,082 issued Dec. 10, 1974 to Rosenberg et al; 3,822,660 issued July 9, 1974 to G. Throner, Jr.; 2,320,948 issued June 1, 1943 to C. T. Marthey; 2,058,708 issued Oct. 27, 1936 to S. Minio; and 2,338,067 issued Dec. 28, 1943 to N. E. Wicklow. Canadian Patents 185,212 issued July 2, 1918 to W. A. Blakesley; 175,081 issued Feb. 13, 1917 to James Stafford; 195,073 issued Dec. 16, 1919 to C. Cheney et al.

The sunken vessel locator and raising systems disclosed in the foregoing typically include (e.g. U.S. Pat. No. 1,331,014), a float, a tag line paid out from a reel and connected to the sunken vessel by way of a coupling anchored to the vessel. Retrieval of the sunken vessel is by way of a winch line from a rescue boat that slides down on the line attached to the float and automatically engages means securely anchored to the vessel. Typically (U.S. Pat. Nos. 1,331,014; 2,347,690) the reel from which the float line is paid out is mounted on the vessel. The only exception to this in the foregoing art is the above-mentioned U.S. Pat. No. 2,058,708 where the reel is mounted in the float.

The systems disclosed in the foregoing art are generally cumbersome and complicated and dedicated to a particular vessel.

A principle object of the present invention is to provide a retrieval system which is self-contained, portable and readily mountable on any vessel without requiring modifications to the latter or attachable to any object having a lift point and readily transferrable from one object to another.

Further objects of the present invention are to provide:

(a) a standard for the industry with a view to reducing insurance claims;

(b) a reliable, simple and convenient transferrable and reusable rescue system; and/or (c) a sunken vessel or object marker and retrieval system that is simple and symmetrical in many respects such that operability is assured.

In keeping with the foregoing there is provided apparatus for use in association with a vessel or water transported objects to facilitate locating and raising the same should it become sunken, said apparatus comprising in combination a float body having an upper portion and a lower portion with the upper portion being of larger cross-sectional area than the lower portion, a recess in the bottom of said lower portion, a cable drum and located in said recess and journaled for rotation to pay out a line reeled thereon as the object to which it is attached sinks, a light duty tag line having one end attached to said reel and a knob on the other end, a heavy duty lifting cable secured at one end thereof to said knob and securable at the opposite end to a suitable and secure lift point(s) on the object, and a sleeve attachable to a sunken object retrieving line and freely slidable along the line portion payed out from said reel, said sleeve having a central passage for said tag line and knob attached thereto and two or more dogs movably mounted on said sleeve, said dogs being biased to project into said central passage for engaging said knob.

LIST OF DRAWINGS

The invention is illustrated by way of example with reference to the accompanying drawings wherein:

FIG. 4 is a top plan view of the sleeve unit that engages a knob on a cable attached to the sunken vessel.

FIG. 5 a sectional view taken along line V—V of FIG. 4; and

FIG. 6 is an elevational view illustrating modifications to the vessel retrieval system.

DETAILED DESCRIPTION OF PREFERRED EMBODIMENT

Figure 1:
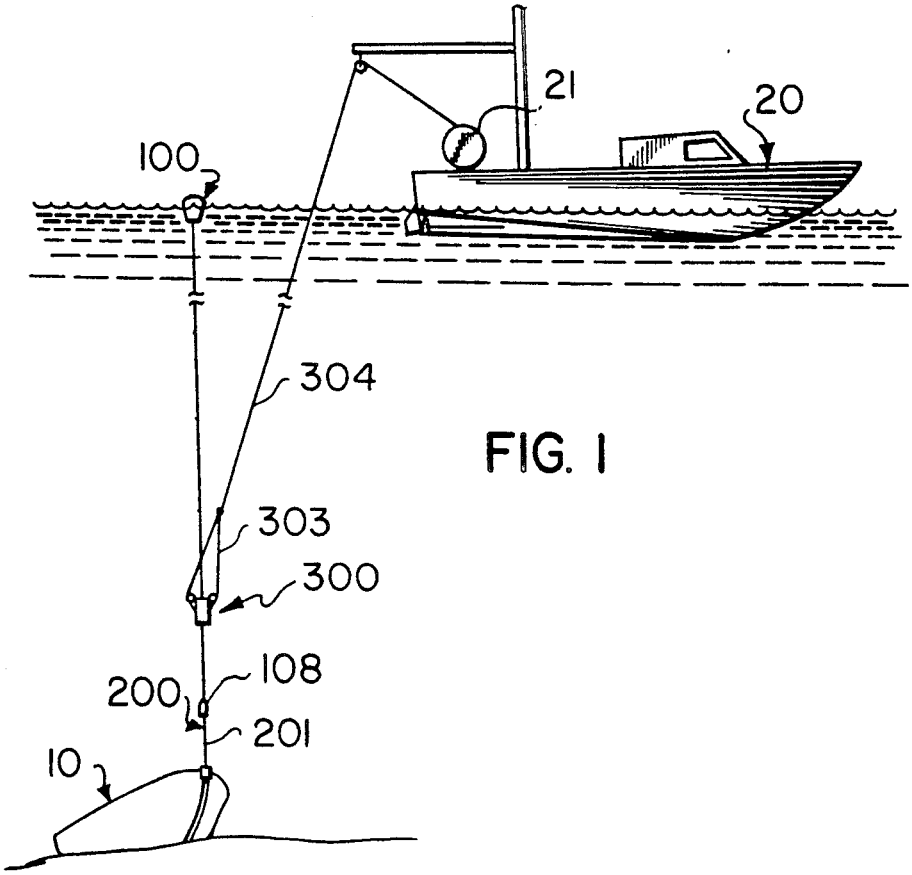
FIG. 1 is a diagrammatic elevational view of a sunken vessel being retrieved by a rescue vessel, utilizing a system provided in accordance with the present invention.

Referring to the drawings, there is illustrated in FIG. 1 a sunken vessel 10 being retrieved by a rescue vessel 20 using a marker and rescue system provided in accordance with the present invention. It is to be understood that the sunken vessel or craft, as illustrated in the drawings, could be any object, for example, a piece of equipment that has toppeled or been dumped overboard from a barge while being transported. On the other hand, the sunken object could be a chemical container, a logging truck or industrial equipment being transported and which has gone overboard. The appartus of the present invention is readily transferrable from one object to another and is useable to mark and facilitate recovery of an object should a mishap occur during transport. The marker and rescue system includes a float cable and reel unit 100, a heavy duty load lift cable 200 attached to the object of concern and a collar retrieval unit 300.

The unit 100 includes a frusto conical cylindrical float 101 having an upper part 102A designed to provide suitable buoyancy and a lower portion 102B having a cavity 103 in the bottom thereof in which is located a reel 104. The reel 104 is journaled for rotation on a shaft 105 with rotation of the reel being restrained by one or more friction plates 106 or other suitable brake means. The friction plates 106 prevent overrun when the float comes up to the surface assuring the float is, as close as possible, vertically above the submerged, sunken object. A quantity of light duty cable or line 107 is wound on the reel which, for example, may be 1,250 feet of 1/16 stainless wire cable or nylon cord. The line 107 has securely attached to the free end thereof a bullet shaped knob 108.

Figure 2:
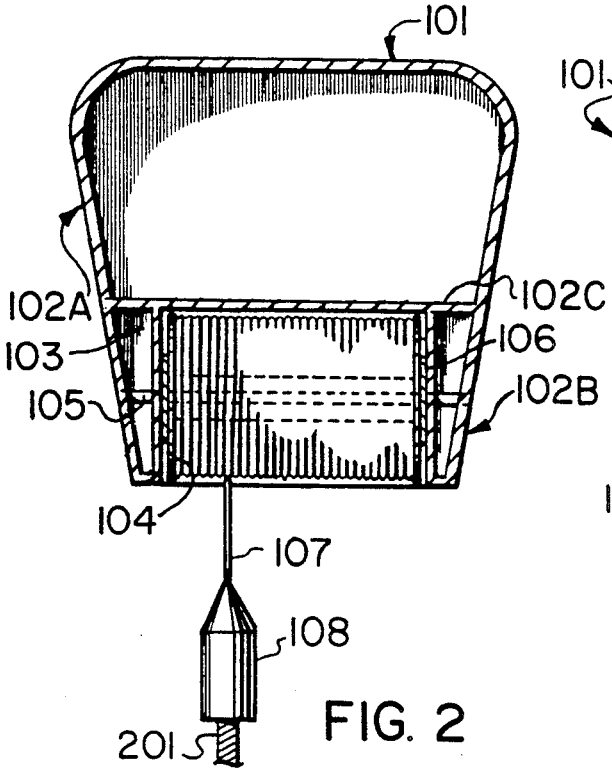
FIG. 2 is a side elevational, partial sectional view of the float, cable and reel portion of the system.
Figure 3:
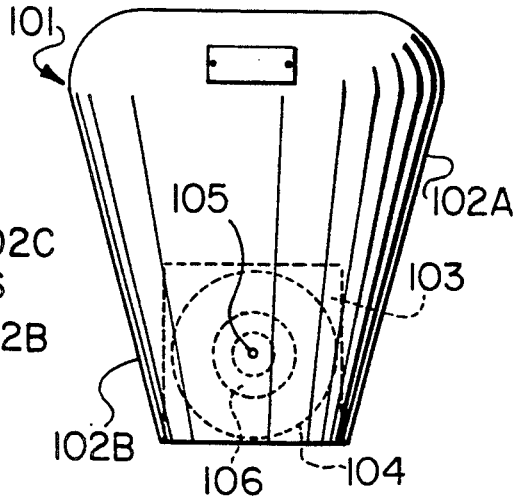
FIG. 3 is a righthand side elevational view of FIG. 2.

The float 101 may be made of aluminum or a plastics material suitably molded (or combinations thereof) with the upper portion 102A being hollow and separated from the lower portion 102B by a wall 102C. The float walls are tapered as is clearly evident from FIG. 2 providing an upper portion 102A which is larger in cross-sectional area than the lower portion 102B. Specifications for the vessel, object or equipment on which the rescue system is used, may be printed on the float at an appropriate location for viewing or appear on a separate plate (P) attached to the float. Other information deemed necessary or useful in retrieval may appear on the plate, such as the type of retrieval anchor to be used, etc.

The unit 200 includes a heavy lift cable 201, strong enough to support the weight of the boat, vessel, object or equipment to which it is attached, and swaged or otherwise fixedly secured to the free end thereof is the bullet shaped knob 108. The cable 201 is fastened securely to the object at appropriate lifting points, ensuring rescue of the object can be accomplished by pulling on the cable 201 without causing structural damage to the object.

The unit 300, best illustrated in FIGS. 4 and 5, is a short, elongate sleeve 301 with a pair of ears 302 attached thereto and to which a cable harness 303 (see FIG. 1) is attached (or attachable thereto). The cable harness 303 is shown, in FIG. 1, attached to a lift cable 304 of the rescue vessel that is wound onto the drum of a power driven winch 21 on the rescue vessel. The sleeve 301 has a narrow gated slot 305 in a wall thereof, just wide enough to allow the insertion of cable 107 into the sleeve.

The sleeve 301 has four dogs 306, pivotally mounted thereon by respective one of four pivot pins 307. The dogs project into the cavity of the sleeve and have a chamfered edge portion 308 that engages and slides on the tapered end of the retrieval knob 108 when the sleeve is lowered down cable 107 to bypass the retrieval knob. The eccentricity of the dogs is such that after they pass the knob they pivot into a position where the edge 309 thereof engages the bottom face of the knob. The eccentricity effectively biases the dogs to a position where they project into the central passage of the sleeve. If desired, a spring loaded bias could be used.

Each dog 306 projects through an opening 310 in a wall of the sleeve and the bottom edge 311 of such opening engages the bottom edge 312 of the dog when the dogs are in a knob engaging position for retrieving the vessel as clearly illustrated in FIG. 5. The pivot pin 307 for the respective dogs is located outboard of the outer wall surface of the sleeve and located such that the edge 312 of the dog engages the outer face of the sleeve, limiting the pivoting of the dog so that when the sleeve is vertical, the dog is always biased to a normal rest position of projecting into the sleeve.

If desired, small leaf springs 320, can be mounted on the sleeve (or an elastic band can encircle the sleeve) to engage the pivoted dogs (also referred to herein as cams) preventing them from turning outwardly too far.

The foregoing describes a system with reference to retrieval of a sunken vessel where the float with the cable and reel mounted thereon and the heavy duty lift cable would normally be part of the gear carried by the vessel and thus dedicated to that vessel. The most preferred embodiment, however, is illustrated in FIG. 6 and is a portable unit that can be readily attached to the article concerned being transported by water and when the article safely arrives at its destination the unit is detached therefrom and used again on another article of concern during transportation thereof. Examples of articles of concern are logging trucks, construction equipment, containerized hazardous wastes, plant equipment and the like.

Referring to FIG. 6, there is illustrated a heavy duty lift cable 201 detachably securable to the article of concern, for example, a vessel as illustrated in FIG. 1 or any object of concern that may fall off into deep water during transportation and either cause a hazard or be valuable thereby dictating or necessitating retrieval of the same. The cable has a first pick up knob 108 attached to one end thereof and means, for example, a closed loop 202 at the opposite end for detachable securement to the object of concern extending from knob 108 as a medium duty lift liner cable 201A having a second knob 108 attached thereto and from which extends the light duty line 107 to the float 101.

During transport of an object of concern, the loop 202 will be attached to a suitable loop point on the object and the float as placed at any convenient location, either on the transporting means or the object itself. Should the object accidentally fall into deep water, the float remains on the surface visually indicating the location of the object to retrieve the object. A first retrieval sleeve unit 400 is lowered along the float attached line 107 until the dogs 401 on unit 400 pass the knob 108A. The sleeve 400 is attached by way of a cable 402 to the rescue vessel and when line 402 is tensioned sufficiently to provide a straight cable, a second retrieval unit 300, of the type illustrated in FIGS. 4 and 5, is lowered along the cable 402 bypassing the first sleeve unit 400 proceeding onto the knob 108. The knob 108 projects into the sleeve sufficiently for the pivoted dogs 306 to engage and abutt the lower or face of the knob as previously described with reference to FIGS. 4 and 5. If desired a stop means such as a ring 330 with a central opening 331 can be secured to the top end of the sleeve 301 to prevent the lift knob 108 from passing through the sleeve. The opening 331 is sized such as to permit knob 108A to pass therethrough but not knob 108.

The dogs 401 on sleeve unit 400 are designed so as to be located internally of the external surface of the sleeve so as not to obstruct bypassing of the larger retrieval sleeve 301.

In the foregoing systems, the float attached line preferably has markings of some nature thereon to indicate the depth of water where the sunken object is located. From this, the rescue vessel can determine the amount of rescue cable needed and from the information plate on the float, the type of equipment can be readily determined. The main line 201 may for example be of a length of 15 to 20 feet, and is securely fastened to a suitable lift point on the object, strong enough to support the weight of the object avoiding structural damage to the same during retrieval. The sleeve 300 of the retrieval unit is attached by way of the harness to the winch cable of the rescue vessel and it is lowered down the float attached cable until the sleeve makes contact and locks onto the knob.

The double system illustrated in FIG. 6 is applicable for heavy objects, large vessels and/or objects or vessels in deeper water. When the object sinks, the float breaks free from a holding cradle for the float on the barge or vessel and the float is then picked up on the surface of the water by the rescue vessel. The information on the float indicates to the rescue party the size, weight and/or nature of the sunken object and the knob sizes and pertinent information for the cables to enable the rescue party to use the appropriate sleeves. In the double system, the first sleeve is passed down the float attached cable until it locks onto the first knob. Tension can then be applied to the line facilitating lowering of the second sleeve that engages the main or second knob on the heavy lifting cable attached to the sunken vessel. For lighter objects and/or in shallower waters a single system may be used in which case the sleeve 400 and cable 402 can be dispensed with. In this instance, as in FIG. 1, line 107 is connected to knob 108. It will be obvious various factors will be considered in determing the appropriate size for the system such as the size and length of cable 107, the capacity of reel 104 and the depth of water that may be encountered.

If desired, an electronic signal sender can be mounted within the hollow float to aid locating where the sinking has taken place triggering of the transmitter can be effected in any convenient manner mechanically, electrically or magnetically by spinning of the reel as it pays out the cable when the sinking of the object of concern.

I claim:

1. Improved Apparatus for use in association with an object of concern transported on water to facilitate locating and raising such object should it through mishap become sunken before reaching its destination, said apparatus comprising in combination:

(a) a float comprising a body having an upper portion and a lower portion with the upper portion being of larger cross-sectional area than the lower portion, and a recess in the bottom of said lower portion;

(b) a cable drum located in said recess and journaled for rotation to pay out a line wound thereon;

(c) said line being a light duty line having one end thereof attached to said reel and wound thereon and having an opposite end with a first knob attached thereto;

(d) a first medium duty lift cable secured at one end thereof to said knob and having a second knob secured to the opposite end thereof, said second knob having a larger cross-sectional dimension than said first knob and a second heavy duty lift cable secured at one end thereof to said second knob and securable at the opposite end to a suitable and secure lift point(s) on the object of concern, said float, cable drum and lines being portable and readily movable from one object of concern to another;

(e) a first sleeve attached to and payable out from a first rescue line; and (f) a second sleeve attachable to a second rescue line, said first sleeve being freely slidable along said light duty line payed out from the reel, over said first knob and being attachable to the latter, said second sleeve being slidable along said light duty line and first rescue line and being of larger size than said first sleeve so as to pass over the same and being engageable with said second knob, said sleeves each having a central through passage and two or more dogs movably mounted on the sleeve and projecting into the passage associated therewith for engaging a respective one of said knobs, said second sleeve having a gated slot extending longitudinally of such sleeve and in a side wall thereof facilitating insertion of lines into its through passage.

2. Apparatus for use with different objects of concern that are transported at different times, said apparatus being portable and readily removable from one object, that has been moved, to another object about to be moved, said apparatus facilitating locating and being useable for raising the object of concern should such object through some mishap become sunken before reaching its destination, said apparatus comprising:

(a) a float body having a reel journaled thereon, said reel being located in a recess in a lower portion of said float body;

(b) first, second and third lift lines connected in series by respective first and second knobs, said first knob interconnecting said first and second lines and being smaller than said second knob which interconnects said second and third lines; and (c) a first sleeve connectable to a first rescue line payed out from a rescue vessel during retrieval of a sunken object and having a passageway therethrough so as to be slidable along said first lift line and over said first knob and a second similar sleeve having a passage therethrough of sufficient size so as to be slidable over said first sleeve and said second knob, said first and second sleeves having lugs movably mounted thereon and projecting into the respective passages thereof for engaging a respective one of said first and second knobs, said second sleeve having a gated slot in a side wall thereof.

* * * * *